US009403651B2

(12) United States Patent
Mizuno et al.

(10) Patent No.: US 9,403,651 B2
(45) Date of Patent: Aug. 2, 2016

(54) IMAGE FORMING APPARATUS

(71) Applicant: KYOCERA Document Solutions Inc., Osaka-shi, Osaka (JP)

(72) Inventors: Masahiko Mizuno, Osaka (JP); Yuki Uohashi, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/686,234

(22) Filed: Apr. 14, 2015

(65) Prior Publication Data

US 2015/0298932 A1 Oct. 22, 2015

(30) Foreign Application Priority Data

Apr. 18, 2014 (JP) ..... 2014-085961

(51) Int. Cl.

| | |
|---|---|
| ***B65H 7/20*** | (2006.01) |
| ***B65H 3/52*** | (2006.01) |
| ***B65H 85/00*** | (2006.01) |
| ***B65H 1/26*** | (2006.01) |
| ***B65H 3/56*** | (2006.01) |
| ***B65H 3/06*** | (2006.01) |
| ***B65H 5/06*** | (2006.01) |

(52) U.S. Cl.

CPC ..... *B65H 7/20* (2013.01); *B65H 1/266* (2013.01); *B65H 3/0607* (2013.01); *B65H 3/0669* (2013.01); *B65H 3/5261* (2013.01); *B65H 3/565* (2013.01); *B65H 5/062* (2013.01); *B65H 85/00* (2013.01); *B65H 2403/42* (2013.01); *B65H 2403/512* (2013.01); *B65H 2403/72* (2013.01); *B65H 2403/94* (2013.01); *B65H 2404/144* (2013.01); *B65H 2405/313* (2013.01); *B65H 2405/332* (2013.01)

(58) Field of Classification Search

CPC ..... B65H 85/00; B65H 7/20; B65H 3/0607; B65H 2403/94; B65H 2403/942; B65H 2403/512; B65H 2405/313; B65H 2301/42324

See application file for complete search history.

(56) References Cited

U.S. PATENT DOCUMENTS

| | | | | |
|---|---|---|---|---|
| 7,744,083 | B2 * | 6/2010 | Kang | B65H 1/18 271/126 |
| 8,020,850 | B1 * | 9/2011 | Blair | B65H 1/14 271/122 |

(Continued)

FOREIGN PATENT DOCUMENTS

| | | |
|---|---|---|
| JP | 2001-253562 | 9/2001 |

*Primary Examiner* — Patrick Cicchino

(74) *Attorney, Agent, or Firm* — Gerald E. Hespos; Michael J. Porco; Matthew T. Hespos

(57) ABSTRACT

An image forming apparatus includes an apparatus main body, a sheet feeding cassette, an image forming section, a delivery member, a conveying member, a lift plate, a driving section, a first switching section, a second switching section, and a driving control section. The conveying member is disposed in the reverse conveying path. The lift plate is enabled to change a position thereof between a sheet feeding position and a retracting position. The first switching section transmits the driving force to the delivery member and the conveying member. The second switching section transmits the driving force to the lift plate. The driving control section controls the first switching section, with the lift plate being placed in the sheet feeding position, to rotate the delivery member, and when the sheet is conveyed through the reverse conveying path, moves the lift plate from the sheet feeding position to the retracting position.

10 Claims, 10 Drawing Sheets

(56) References Cited

U.S. PATENT DOCUMENTS 8,800,986 B2 * 8/2014 Tomatsu ..... G03G 15/757 271/126
2003/0053834 A1 * 3/2003 Suzuki ..... G03G 15/6514 399/392
2005/0087921 A1 * 4/2005 Aoki ..... B65H 1/18 271/126
2009/0008868 A1 * 1/2009 Kuroda ..... B65H 3/0607 271/162
2011/0180985 A1 * 7/2011 Yamamoto ..... B65H 3/0607 271/117
2012/0104680 A1 * 5/2012 Blair ..... B65H 1/266 271/110
2013/0241136 A1 * 9/2013 Hosohara ..... B65H 3/06 271/18
2014/0145392 A1 * 5/2014 Tanio ..... B65H 1/266 271/121

* cited by examiner

IMAGE FORMING APPARATUS

INCORPORATION BY REFERENCE

The present application is based on Japanese Patent Application No. 2014-085961 filed at the Japanese Patent Office on Apr. 18, 2014, the contents of which are incorporated herein by reference.

BACKGROUND ART

The present disclosure relates to an image forming apparatus that forms an image on a sheet.

A conventionally known image forming apparatus that forms an image on a sheet includes a sheet feeding section, an image forming section, a fixing section, and a sheet discharging section. A sheet from stacked sheets in the sheet feeding section is delivered to a sheet conveying path by a sheet feeding roller, and then, an image forming section forms an image on the sheet. Thereafter, the fixing section executes a fixing process on the sheet, and then the sheet is discharged into the sheet discharging section.

In such a technique, a timing when the sheet is delivered from the sheet feeding section is different from a timing when the sheet passes through the image forming section or the fixing section. Thus, driving sections specific to the respective timings are needed.

SUMMARY OF INVENTION

An image forming apparatus according to an aspect of the present disclosure includes an apparatus main body, a sheet feeding cassette, an image forming section, a sheet conveying path, a reverse conveying path, a delivery member, a conveying member, a lift plate, a driving section, a first switching section, a second switching section, and a driving control section. The sheet feeding cassette is removable from the apparatus main body, and sheets are stacked inside the sheet feeding cassette. The image forming section forms an image on the sheet. The sheet conveying path extends from the sheet feeding cassette so as to pass through the image forming section, and the sheet is conveyed through the sheet conveying path. The reverse conveying path is formed downstream of the image forming section in a conveying direction of the sheet so as to branch from the sheet conveying path. At the time of duplex image formation in which an image is formed on each of opposite surfaces of the sheet, the reverse conveying path allows the sheet to be loaded again into an upstream side portion of the sheet conveying path with respect to the image forming section in the conveying direction. The delivery member is disposed opposite the sheet feeding cassette and rotationally driven to deliver the sheet. The conveying member is disposed in the reverse conveying path and rotationally driven to convey the sheet. The lift plate is disposed in the sheet feeding cassette, and the sheet is stacked on an upper surface of the lift plate. The lift plate is enabled to change a position thereof between a sheet feeding position where the stacked sheet is brought into abutting contact with the delivery member and a retracting position where the sheet is retracted from the delivery member. The driving section generates a driving force. The first switching section transmits the driving force generated by the driving section to the delivery member and the conveying member to rotate or stop the delivery member and the conveying member. The second switching section transmits the driving force generated by the driving section to the lift plate to change the position of the lift plate. The driving control section controls the first switching section and the second switching section. The driving control section controls the first switching section, with the lift plate being placed in the sheet feeding position, to rotate the delivery member to feed the sheet into the sheet conveying path, and when the sheet is conveyed through the reverse conveying path, controls the second switching section to move the lift plate from the sheet feeding position to the retracting position.

Furthermore, an image forming apparatus according to another aspect of the present disclosure includes an apparatus main body, a first sheet feeding cassette and a second sheet feeding cassette, an image forming section, a sheet conveying path, a first delivery member, a second delivery member, a first lift plate, a second lift plate, a driving section, a first switching section, a second switching section, a third switching section, and a driving control section. The first sheet feeding cassette and the second sheet feeding cassette are removable from the apparatus main body, and sheets are stacked inside the first sheet feeding cassette and the second sheet feeding cassette. The image forming section forms an image on the sheet. A portion of the sheet conveying path extends from the first sheet feeding cassette and another portion of the sheet conveying path extends from the second sheet feeding cassette, and the portion from the first sheet feeding cassette and the portion from the second sheet feeding cassette then join together, and the sheet is conveyed through the sheet conveying path so as to pass through the image forming section. The first delivery member is disposed opposite the first sheet feeding cassette and rotationally driven to deliver the sheet. The second delivery member is disposed opposite the second sheet feeding cassette and rotationally driven to deliver the sheet. The first lift plate is disposed in the first sheet feeding cassette, and the sheet is stacked on an upper surface of the first lift plate. The first lift plate is enabled to change a position thereof between a sheet feeding position where the stacked sheet is brought into abutting contact with the first delivery member and a retracting position where the sheet is refracted from the first delivery member. The second lift plate is disposed in the second sheet feeding cassette, and the sheet is stacked on an upper surface of the second lift plate. The second lift plate is enabled to change a position thereof between a sheet feeding position where the stacked sheet is brought into abutting contact with the second delivery member and a retracting position where the sheet is retracted from the second delivery member. The driving section generates a driving force. The first switching section transmits the driving force generated by the driving section to the first and second delivery members, and rotates or stops the first and second delivery members. The second switching section transmits the driving force generated by the driving section to the first lift plate to change the position of the first lift plate. The third switching section transmits the driving force generated by the driving section to the second lift plate to change the position of the second lift plate. The driving control section controls the first switching section, the second switching section, and the third switching section. The driving control section controls the second switching section or the third switching section to place the lift plate in one of the first and second sheet feeding cassettes in the sheet feeding position, while placing the lift plate in the other of the first and second sheet feeding cassettes in the retracting position, and in this state, controls the first switching section to rotate the first and second delivery members to load the sheet into the sheet conveying path.

DESCRIPTION OF EMBODIMENTS

Figure 1:
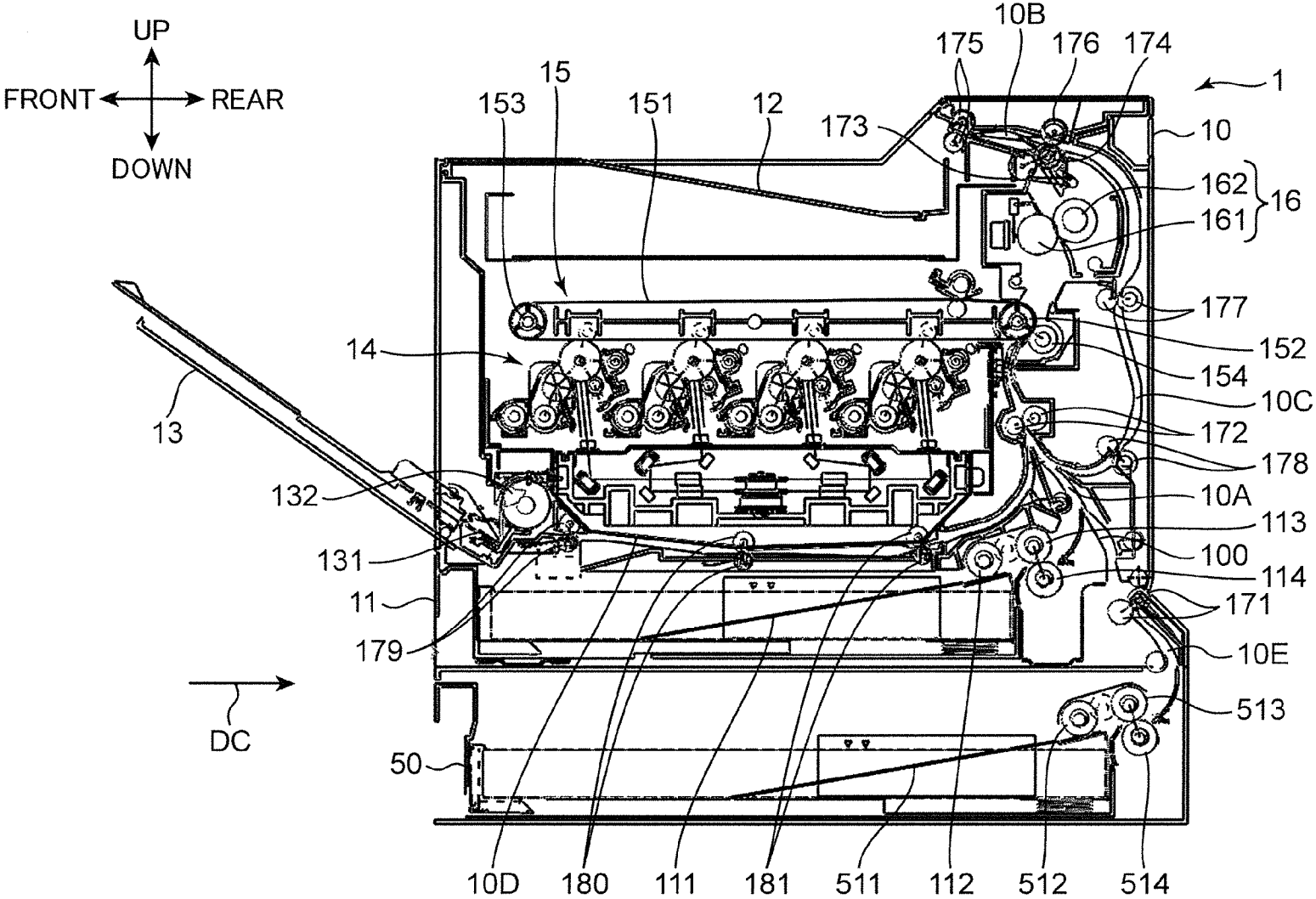
FIG. 1 is a cross-sectional view depicting the internal structure of an image forming apparatus according to an embodiment of the present disclosure.

An embodiment of the present disclosure will be described below based on the drawings. FIG. 1 is a cross-sectional view depicting the internal structure of an image forming apparatus 1 according to an embodiment of the present disclosure. As the image forming apparatus 1, a printer is illustrated herein. However, the image forming apparatus may be a multifunction printer with a printer function and a copy function, a copier, or a facsimile apparatus.

<Description of the Image Forming Apparatus>

An image forming apparatus 1 includes an apparatus main body 10 with a housing structure shaped generally like a rectangular parallelepiped. A sheet discharging section 12 is disposed in an upper surface portion of the apparatus main body 10. A sheet with an image formed thereon is discharged on the sheet discharging section 12. The apparatus main body 10 internally houses a sheet feeding cassette 11 (first sheet feeding cassette), an image forming section 14 that forms a toner image (developer image) on the sheet, an intermediate transfer section 15, and a fixing section 16 that fixes the toner image to the sheet. Furthermore, a manual tray 13 is provided on a front side surface of the apparatus main body 10 so as to be freely opened and closed. Sheets can be placed on an upper surface of the manual tray 13.

The sheet feeding cassette 11 is removable from the apparatus main body 10, and sheets are stacked inside the sheet feeding cassette 11. In the present embodiment, the sheet feeding cassette 11 is installed in an installation direction that is rearward with respect to the apparatus main body 10 (arrow DC in FIG. 1). Inside the sheet feeding cassette 11, a first lift plate 111 (lift plate) is provided. Sheets are stacked on an upper surface of the first lift plate 111. The first lift plate 111 enables its position to be changed between a sheet feeding position where a leading end of the uppermost one of the stacked sheets is brought into abutting contact with a first pickup roller 112 described below and a retracting position where the sheet is retracted from the first pickup roller 112. A bias spring not depicted in the drawings is disposed between the first lift plate 111 and a bottom of the sheet feeding cassette 11. The bias spring biases the first lift plate 111 upward so as to place the first lift plate 111 in the sheet feeding position. Movement of the first lift plate 111 will be described below in detail.

The image forming section 14 is disposed above the sheet feeding cassette 11. The image forming section 14 includes a plurality of photosensitive drums and developing apparatuses corresponding to a yellow color, a magenta color, a cyan color, and a black color, respectively. An electrostatic latent image according to image data is formed on the photosensitive drum by an exposure apparatus. A toner image on the photosensitive drum developed by the developing apparatus is primarily transferred to an intermediate transfer belt 151 in the intermediate transfer section 15 so as to be superimposed on the intermediate transfer belt 151.

The intermediate transfer section 15 includes the intermediate transfer belt 151, a belt driving roller 152, and a tension roller 153. The intermediate transfer belt 151 is an endless belt stretched between the belt driving roller 152 and the tension roller 153. The belt driving roller 152 is rotationally driven by a motor M described below to circumferentially move the intermediate transfer belt 151. At a position opposite the belt driving roller 152 across the intermediate transfer belt 151, a secondary transfer roller 154 is disposed. The secondary transfer roller 154 forms a secondary transfer nip portion between the secondary transfer roller 154 and the belt driving roller 152. A secondary transfer voltage applied to the belt driving roller 152 or the secondary transfer roller 154 allows the toner image to be transferred from the intermediate transfer belt 151 to the sheet.

The fixing section 16 executes a fixing process for the toner image on the sheet. The fixing section 16 includes a fixing roller 161 and a pressuring roller 162. The fixing roller 161 internally includes a heat source. The fixing roller 161 is rotationally driven by the motor M described below. The pressuring roller 162 is pressed against a peripheral surface of the fixing roller 161 to rotate in conjunction with the fixing roller 161.

Inside the apparatus main body 10, a main conveying path 10A (sheet conveying path), a discharge conveying path 10B, a reverse conveying path 10C, and a manual conveying path 10D are arranged. The main conveying path 10A is a conveying path which extends from the sheet feeding cassette 11 so as to pass through the image forming section 14 and the fixing section 16 in the apparatus main body 10 and through which the sheet is conveyed. An inlet side of the main conveying path 10A extends along the installation direction from the sheet feeding cassette 11. Then, the main conveying path 10A extends upward and then forward again to an area above the sheet discharging section 12. Thus, when the image forming apparatus 1 is viewed from left (a cross-sectional view corresponding to FIG. 1 as viewed from the back side of the sheet of the drawing), the main conveying path 10A extending from the sheet feeding cassette 11 appears to be generally C-shaped. The discharge conveying path 10B is a conveying path disposed on a downstream side of the main conveying path 10A in the conveying direction and through which the sheet is conveyed toward the sheet discharging section 12. The reverse conveying path 10C is a conveying path formed on the downstream side with respect to the fixing section 16 in the conveying direction of the sheet so as to branch from the main conveying path 10A. At the time of duplex image formation in which an image is formed on the opposite surfaces of the sheet, the reverse conveying path 10C allows the sheet to be loaded again into a portion of the main conveying path 10A that lies on an upstream side with respect to the image forming section 14. The manual conveying path 10D is a conveying path extending rearward from the manual tray 13 and a conveying-direction downstream side of the manual conveying path 10D is coupled to the main conveying path 10A.

Moreover, the image forming apparatus 1 includes the first pickup roller 112 (delivery member or first delivery member), a first sheet feeding roller 113 (sheet feeding member), a first retard roller 114 (opposite member), a manual lift plate 131, and a manual sheet feeding roller 132. Furthermore, the image forming apparatus 1 includes a first conveying roller pair 171, a registration roller pair 172, a first driven roller 173, an opposite driving roller 174, a discharge roller pair 175, a second driven roller 176, a second conveying roller pair 177 (conveying member), a third conveying roller pair 178 (conveying member), a fourth conveying roller pair 179, a fifth conveying roller pair 180, and a sixth conveying roller pair 181.

The first pickup roller 112 is disposed on the inlet side of the main conveying path 10A opposite the sheet feeding cassette 11. The first pickup roller 112 is rotated to deliver the sheet toward the main conveying path 10A. The first sheet feeding roller 113 is disposed on the downstream side with respect to the first pickup roller 112 in the conveying direction at a distance from the first pickup roller 112. The first sheet feeding roller 113 is rotated to convey the sheet delivered by the first pickup roller 112 further downstream along the main conveying path 10A. The first retard roller 114 is disposed opposite the first sheet feeding roller 113 to form, between the first retard roller 114 and the first sheet feeding roller 113, a nip portion through which the sheet passes.

The manual lift plate 131 is disposed at a downstream-side end of the manual tray 13 in the conveying direction. A lower end of the manual lift plate 131 can be moved up and down by a cam not depicted in the drawings. The manual sheet feeding roller 132 is a roller disposed inside the apparatus main body 10 opposite the manual lift plate 131. The manual sheet feeding roller 132 is rotated by the motor M described below. When the manual lift plate 131 moves upward, the leading end of the sheet disposed on the manual tray 13 comes into abutting contact with the manual sheet feeding roller 132, and the sheet is loaded into the manual conveying path 10D. A solenoid not depicted in the drawings is coupled to the above-described cam. A driving control section 80 described below controls the solenoid to move the manual lift plate 131 up and down to control a delivery operation for the sheet on the manual lift plate 131. Thus, the manual sheet feeding roller 132 is constantly rotationally driven by the motor M.

The first conveying roller pair 171 is disposed at a rear, lower end of the apparatus main body 10. The first conveying roller pair 171 conveys the sheet delivered by an additional cassette 50 described below toward the registration roller pair 172. The registration roller pair 172 is a roller pair disposed in the main conveying path 10A between the first sheet feeding roller 113 and the secondary transfer roller 154. When the leading end of the sheet arrives immediately in front of the nip portion of the registration roller pair 172, conveyance of the sheet is temporarily stopped. Then, the registration roller pair 172 conveys the sheet toward the secondary transfer nip portion in association with an image formation timing in the image forming section 14. Furthermore, the registration roller pair 172 has a function to correct skews in the sheet.

The first driven roller 173, the opposite driving roller 174, and the second driven roller 176 are three rollers disposed above the fixing section 16 adjacently to one another. The opposite driving roller 174 forms a nip portion between the opposite driving roller 174 and the first driven roller 173 and between the opposite driving roller 174 and the second driven roller 176. When the opposite driving roller 174 is rotationally driven by the motor M described below, the first driven roller 173 and the second driven roller 176 rotate in conjunction with the opposite driving roller 174. The sheet passing through the nip portion between the first driven roller 173 and the opposite driving roller 174 is conveyed toward the discharge roller pair 175 along the discharge conveying path 10B.

The discharge roller pair 175 is a roller pair disposed near an outlet of the discharge conveying path 10B. The discharge roller pair 175 is rotationally driven by the motor M described below. Furthermore, the discharge roller pair 175 is controlled to be driven so as to rotate forward and backward. A forward rotating operation of the discharge roller pair 175 allows the sheet to be discharged on the sheet discharging section 12. On the other hand, when the discharge roller pair 175 performs a reverse operation with the sheet held at the nip portion of the discharge roller pair 175, the sheet passes through the nip portion between the second driven roller 176 and the opposite driving roller 174 and is loaded into the reverse conveying path 10C.

The second conveying roller pair 177 and the third conveying roller pair 178 are roller pairs disposed in the reverse conveying path 10C. The second conveying roller pair 177 and the third conveying roller pair 178 are rotationally driven by the motor M described below. The roller pairs load the sheet into the main conveying path 10A again.

The fourth conveying roller pair 179, the fifth conveying roller pair 180, and the sixth conveying roller pair 181 are roller pairs disposed in the manual conveying path 10D. The roller pairs load the sheet from the manual conveying path 10D into the main conveying path 10A.

Moreover, the image forming apparatus 1 includes the additional cassette 50 (second sheet feeding cassette). The additional cassette 50 is selectively installed in a lower surface portion of the apparatus main body 10, and sheets are stacked inside the additional cassette 50. When the additional cassette 50 is installed in the apparatus main body 10, an additional conveying path 10E (sheet conveying path) is formed which extends from the additional cassette 50 and which joins the main conveying path 10A. The additional conveying path 10E joins the main conveying path 10A inside the apparatus main body 10. The additional cassette 50 includes a second lift plate 511, a second pickup roller 512 (second delivery member), a second sheet feeding roller 513 (second delivery member), a second retard roller 514 (opposite member). Sheets are stacked on an upper surface of the second lift plate 511. The second lift plate 511 enables its position to be changed between a sheet feeding position where the leading end of the uppermost one of the stacked sheets is brought into abutting contact with the second pickup roller 512 and a retracting position where the sheet is retracted from the second pickup roller 512.

The second pickup roller 512 is disposed on an inlet side of the additional conveying path 10E opposite the second lift plate 511. The second pickup roller 512 is rotated to deliver the sheet toward the additional conveying path 10E. The second sheet feeding roller 513 is disposed on the downstream side with respect to the second pickup roller 512 in the conveying direction at a distance from the second pickup roller 512. The second sheet feeding roller 513 is rotated to convey the sheet delivered by the second pickup roller 512 further downstream along the additional conveying path 10E. The second retard roller 514 is disposed opposite the second sheet feeding roller 513 to form, between the second retard roller 514 and the second sheet feeding roller 513, a nip portion through which the sheet passes.

Figure 2A:
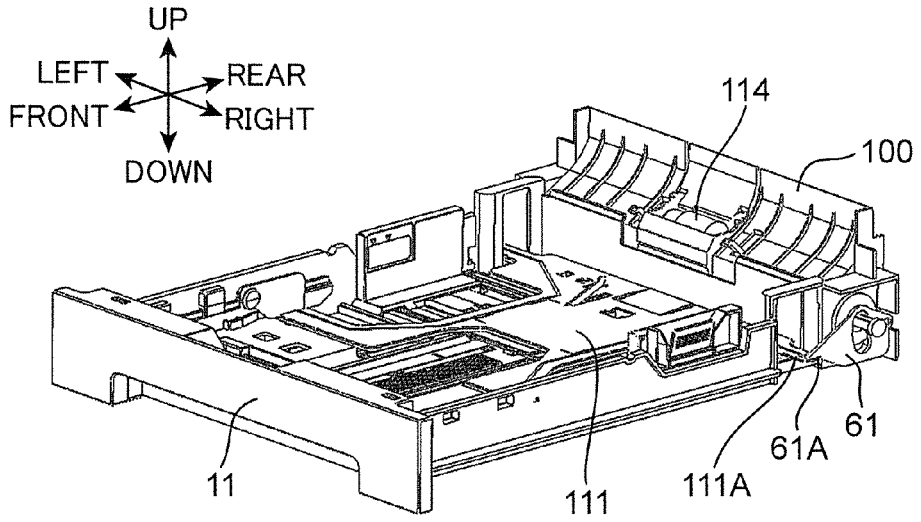
FIG. 2A and FIG. 2B are perspective views of a sheet feeding cassette according to the embodiment of the present disclosure.
Figure 2B:
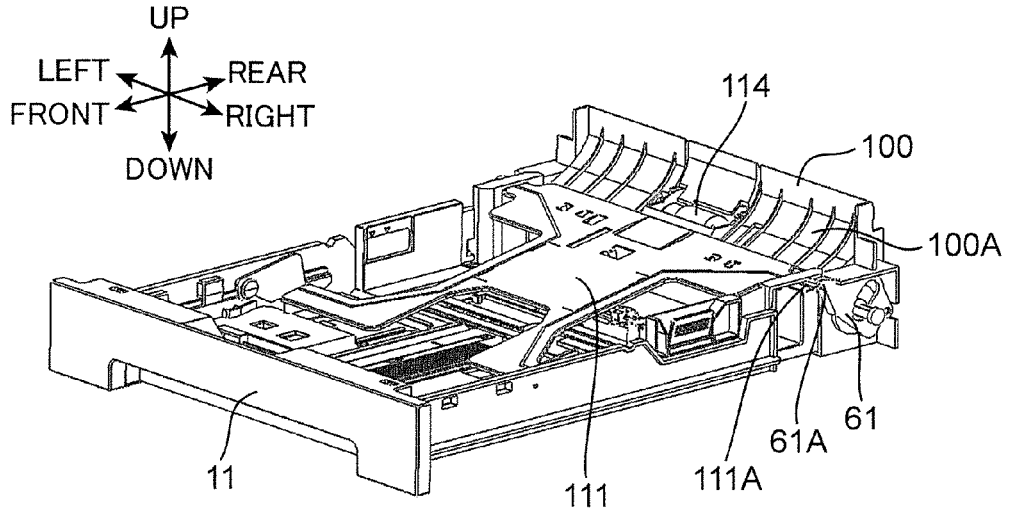
Figure 3:
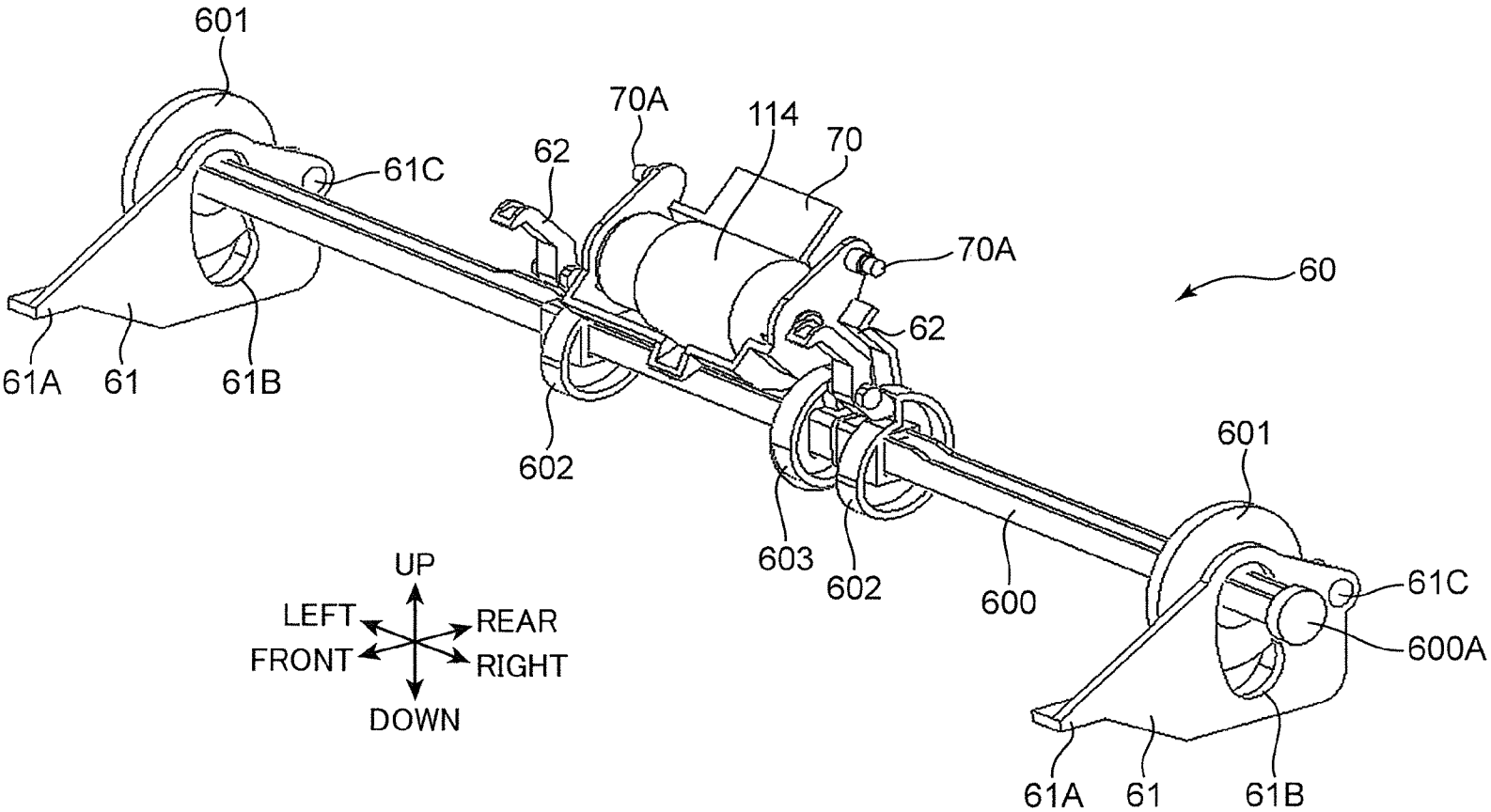
FIG. 3 is a perspective view of a mechanism that moves a lift plate of the sheet feeding cassette according to the embodiment of the present disclosure up and down.
Figure 4A:
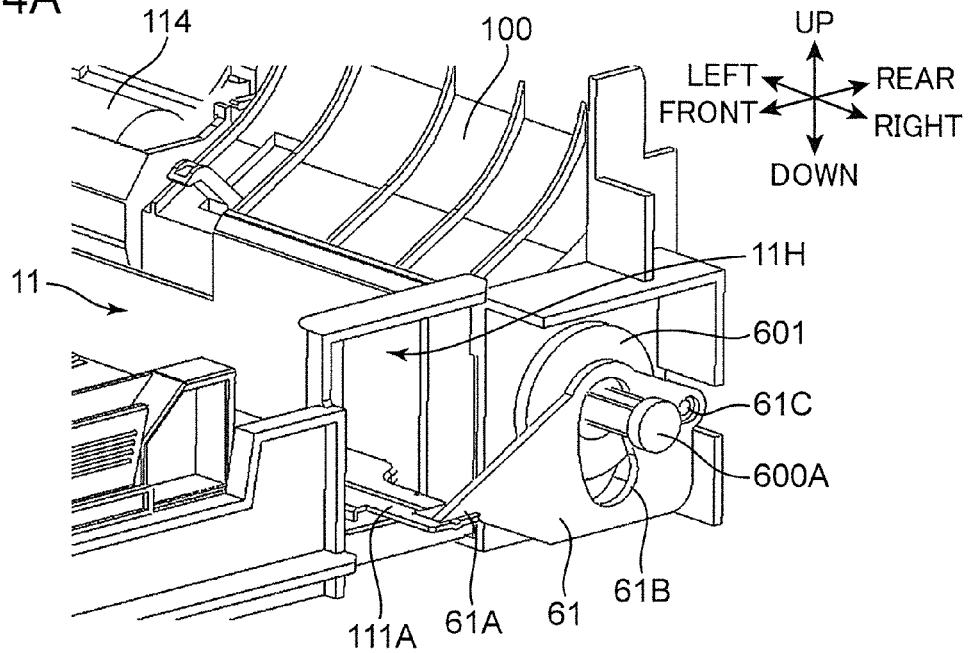
FIG. 4A and FIG. 4B are perspective views depicting how the lift plate of the sheet feeding cassette according to the embodiment of the present disclosure moves up and down.
Figure 4B:
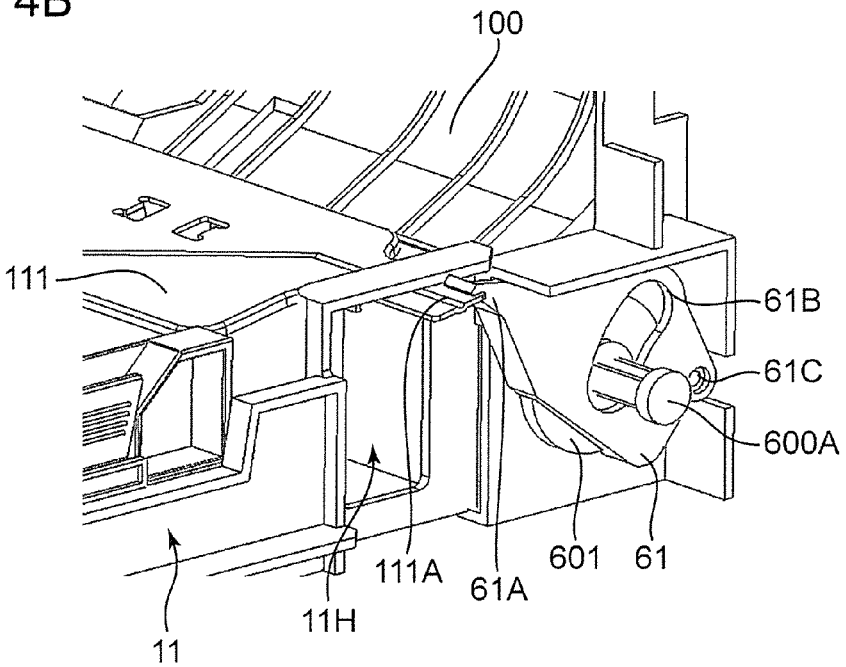
Figure 5B:
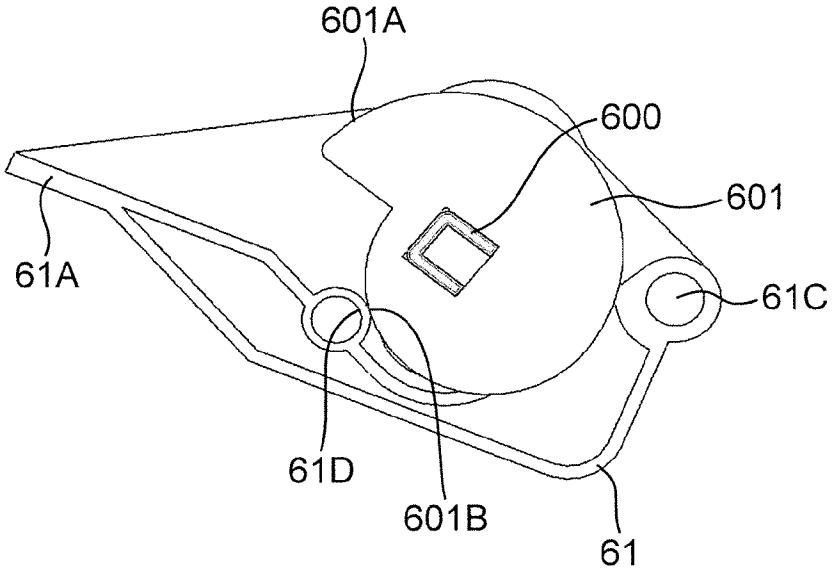
FIG. 5A and FIG. 5B are cross-sectional views of periphery of a cam that moves the lift plate of the sheet feeding cassette according to the embodiment of the present disclosure up and down.
Figure 5A:
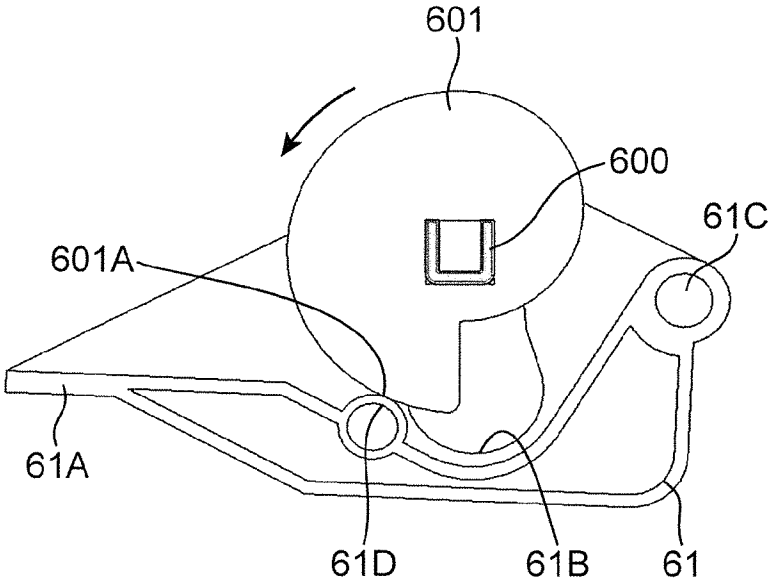
Figure 6A:
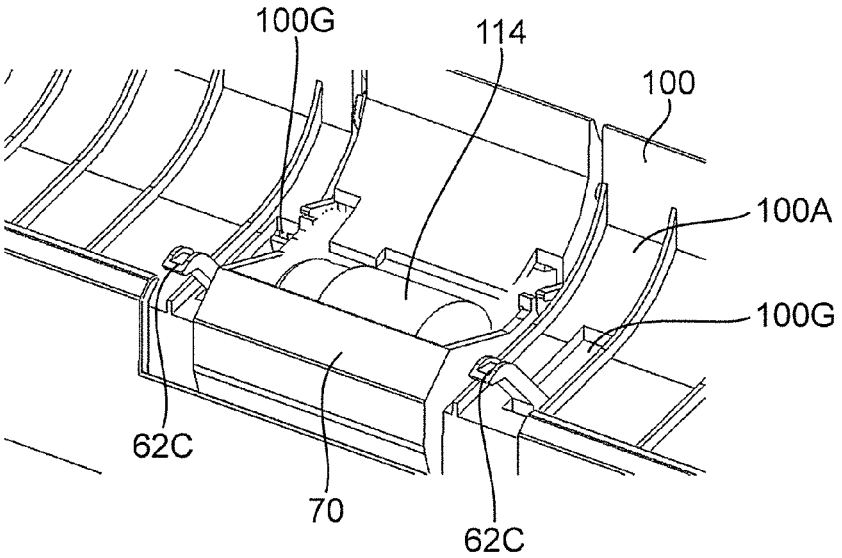
FIG. 6A and FIG. 6B are perspective views of periphery of an opposite member and a returning member according to the embodiment of the present disclosure.
Figure 6B:
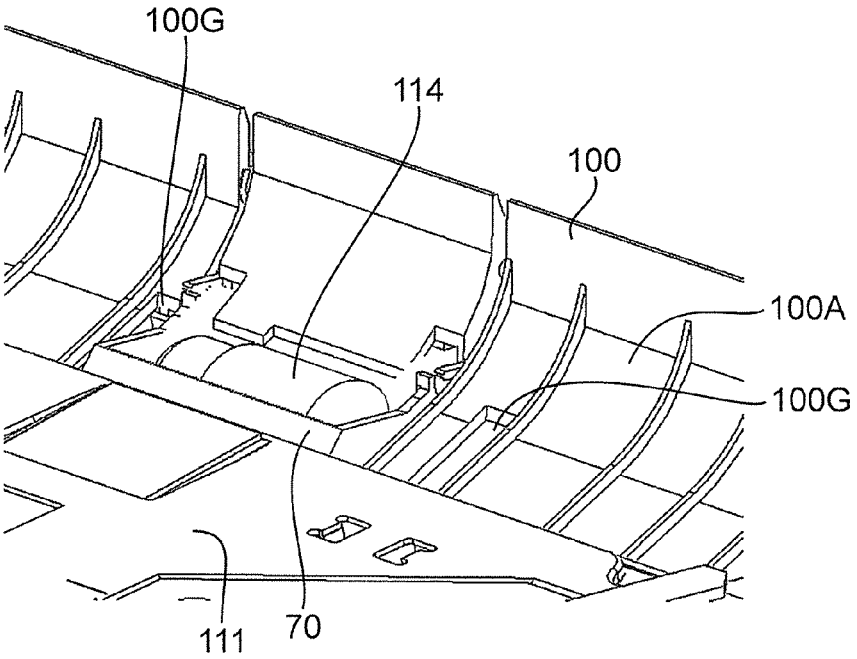
Figure 7B:
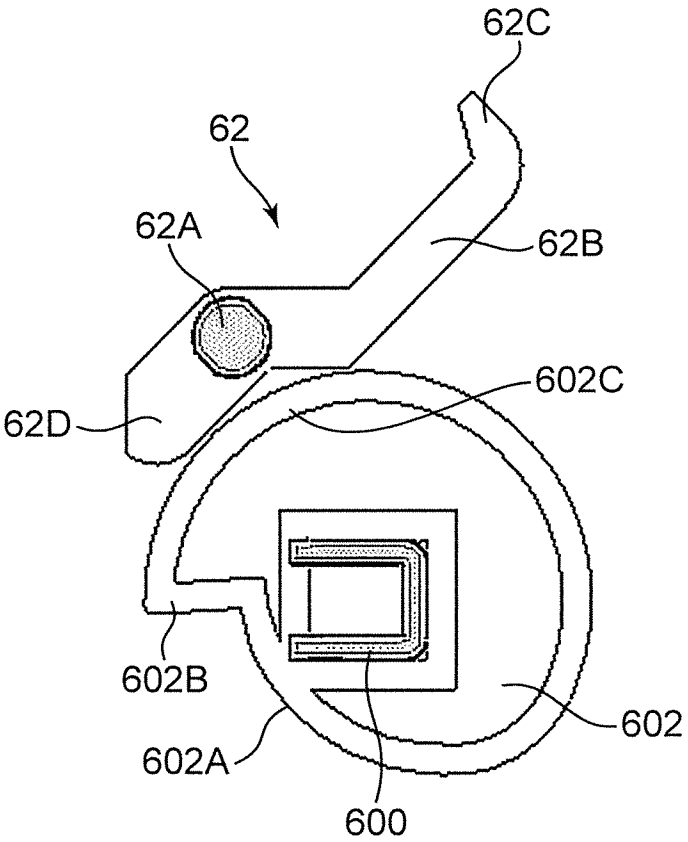
FIG. 7A and FIG. 7B are cross-sectional views of periphery of a cam that projects and retracts the returning member according to the embodiment of the present disclosure.
Figure 7A:
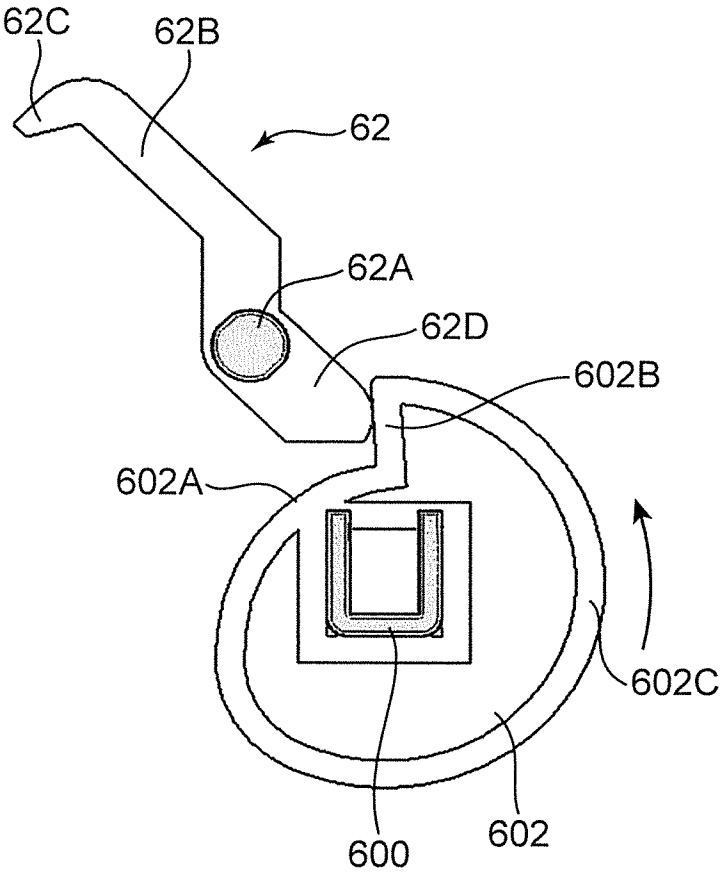
Figure 8B:
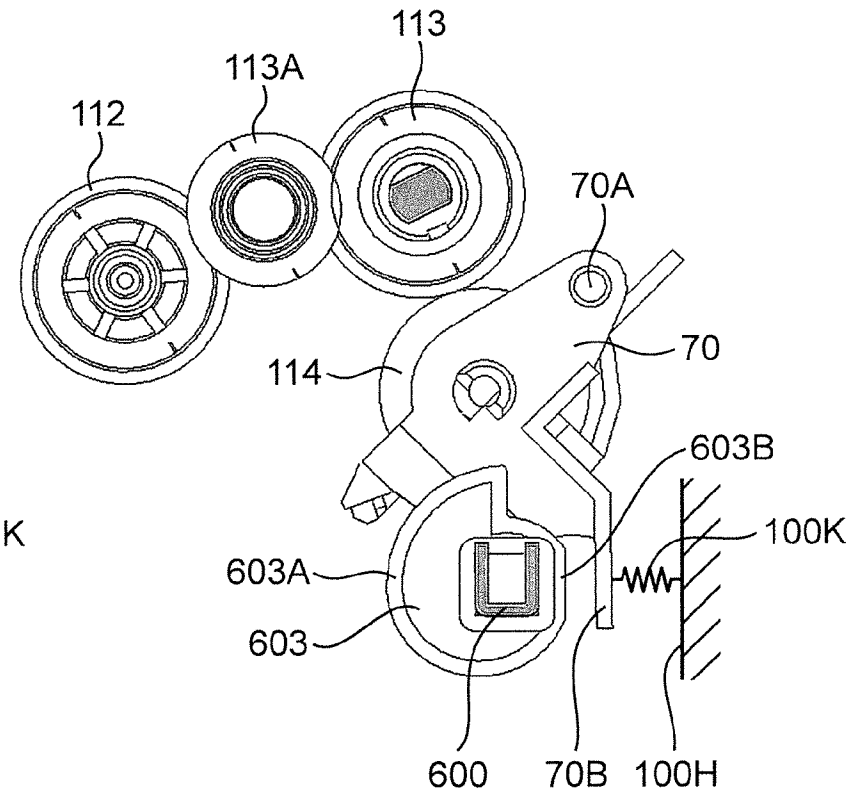
FIG. 8A and FIG. 8B are cross-sectional views depicting how the opposite member according to the embodiment of the present disclosure moves.
Figure 8A:
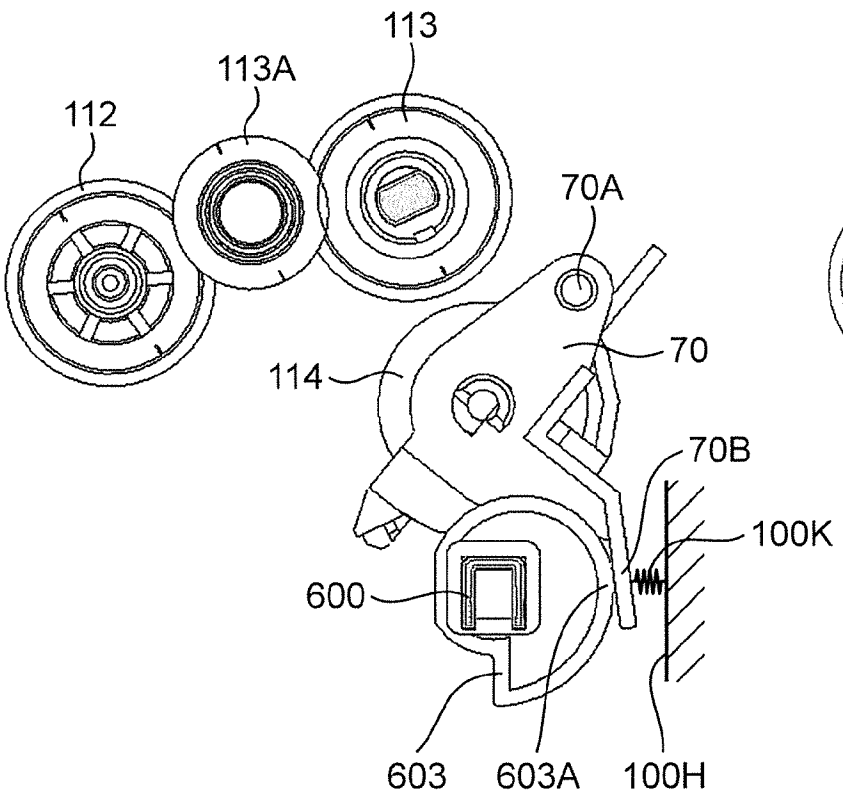

Now, the structure of periphery of the sheet feeding cassette 11 in the image forming apparatus 1 will further be described in detail with reference to FIGS. 2A to 8B. The following configuration is also applied to the additional cassette 50. FIG. 2A and FIG. 2B are perspective views of the sheet feeding cassette 11 according to the present embodiment. FIG. 3 is a perspective view of a mechanism that moves the first lift plate 111 of the sheet feeding cassette 11 up and down. FIG. 4A and FIG. 4B are perspective views depicting how the first lift plate 111 of the sheet feeding cassette 11 moves up and down. FIG. 5A and FIG. 5B are cross-sectional views of periphery of a first cam 601 that moves the first lift plate 111 of the sheet feeding cassette 11 according to the embodiment of the present disclosure up and down. FIG. 6A and FIG. 6B are perspective views of periphery of the first retard roller 114 and a returning member 62 described blow according to the embodiment of the present invention. FIG. 7A and FIG. 7B are cross-sectional views of periphery of a second cam 602 that projects and retracts the returning member 62. FIG. 8A and FIG. 8B are cross-sectional views depicting how the first retard roller 114 moves.

As seen in FIG. 2A, the image forming apparatus 1 includes a conveyance guide section 100. The conveyance guide section 100 is a unit which is a part of the apparatus main body 10 and which is disposed behind the sheet feeding cassette 11. An upper surface portion of the conveyance guide section 100 includes a curved surface 100A that defines a part of the main conveying path 10A. In a central portion of the curved surface 100A in a lateral direction, the first retard roller 114 described above is disposed. The first retard roller 114 is supported by a holder 70 described below. Furthermore, the curved surface 100A has a pair of slits 100G such that the first retard roller 114 is sandwiched between the slits 100G in the lateral direction (FIG. 6A and FIG. 6B).

As seen in FIG. 3, the image forming apparatus 1 includes an interlocking section 60. The interlocking section 60 is a mechanism that serves to allow for an up-down movement of the first lift plate 111, a projecting and retracting operation of the returning member 62 described below, and a moving operation of the first retard roller 114. The interlocking section 60 includes a first shaft 600 (shaft), a pressing arm 61, the returning member 62, and the holder 70 (support member). The first shaft 600 has a first cam 601, a second cam 602, a third cam 603 each disposed on a circumferential surface of the first shaft 600.

The first shaft 600 is a rotating shaft extending in the lateral direction. In FIG. 2A, the first shaft 600 is disposed inside the conveyance guide section 100. A shaft gear 600A is fixed to a right end of the first shaft 600. The shaft gear 600A is coupled to the motor M via a transmission mechanism not depicted in the drawings. Thus, the first shaft 600 is rotationally driven by the motor M. As depicted in FIG. 4A and FIG. 4B, the right end of the first shaft 600 including the shaft gear 600A is exposed to the right of the conveyance guide section 100.

As seen in FIG. 3, the first cam 601 is a pair of cams fixed to the right and left ends of the first shaft 600. The first cam 601 allows the first lift plate 111 to be moved up and down between the sheet feeding position and the retracting position via the pressing arm 61. The second cam 602 is a pair of cams located inside the first cam 601 at a distance from the first cam 601 in the lateral direction and fixed to the first shaft 600. The second cam 602 allows the returning member 62 to pivot and allows the returning member 62 to perform an operation of projecting into and retracting from the main conveying path 10A. The third cam 603 is a cam located adjacently to the right second cam 602 and fixed to the first shaft 600. The third cam 603 has a function to move the first retard roller 114 between an opposite position and retracting position via the holder 70. As depicted in FIG. 5A, FIG. 7A, and FIG. 8, the first cam 601, the second cam 602, and the third cam 603 are formed such that outer diameters of the cams 601, 602, and 603 partly differ in a circumferential direction.

The pressing arm 61 is a pair of arm members disposed opposite the respective cams of the first cam 601. The pressing arm 61 includes an arm pressing section 61A, an arm opening 61B, an arm fulcrum section 61C, and an arm pressed section 61D (FIG. 5A and FIG. 5B). The arm pressing section 61A is disposed in a front side of the pressing arm 61 and tapered forward. The arm pressing section 61A has a function to press a lift plate protruding portion 111A (FIG. 2A and FIG. 2B) of the first lift plate 111. The arm opening 61B is a slot-like opening formed in a central portion of the pressing arm 61 and shaped like a circular arc. As depicted in FIG. 4A and FIG. 4B, the first shaft 600 is inserted through the arm opening 61B. The arm fulcrum section 61C serves as a fulcrum portion for pivoting of the pressing arm 61. The arm fulcrum section 61C is pivotally supported by the conveyance guide section 100. The arm pressed section 61D is a part of the bottom of the pressing arm 61. The arm pressed section 61D is formed to have a predetermined width in the lateral direction and is pressed by the first cam 601. As depicted in FIG. 4A and FIG. 4B, a rectangular opening 11H is formed at a rear end of a right sidewall of the sheet feeding cassette 11. The first lift plate 111 includes the lift plate protruding portion 111A. The lift plate protruding portion 111A is a protruding portion provided on the first lift plate 111 so as to protrude rightward through the cassette opening 11H. The pressing arm 61 is supported by the conveyance guide section 100 so as to dispose that arm pressing section 61A above the lift plate protruding portion 111A.

As seen in FIG. 3, FIG. 7A, and FIG. 7B, the returning member 62 is a bar-like member rotatably supported inside the conveyance guide section 100. The returning member 62, protruding, around the first sheet feeding roller 113 (first retard roller 114), into the main conveying path 10A, has a function of pushing the sheet, delivered from the sheet feeding cassette 11 to the main conveying path 10A, back toward the sheet feeding cassette 11. The returning member 62 includes a returning member fulcrum portion 62A, a first extending portion 62B, a sheet abutting contact portion 62C, and a second extending portion 62D (FIG. 7A). The returning member fulcrum portion 62A serves as a fulcrum point for pivoting of the returning member 62. The returning member fulcrum portion 62A is rotatably pivotally supported by the conveyance guide section 100. A coil spring not depicted in the drawings is provided around the returning member fulcrum portion 62A. The coil spring biases the returning member 62 around the returning member fulcrum portion 62A so as to allow the sheet abutting contact portion 62C of the returning member 62 to protrude into the main conveying path 10A. The first extending portion 62B is a portion extending in one direction from the returning member fulcrum portion 62A. The sheet abutting contact portion 62C is formed by bending a tip of the first extending portion 62B. Pivoting of the returning member 62 around the returning member fulcrum portion 62A causes the sheet abutting contact portion 62C to protrude into the main conveying path 10A through the slit 100G (FIG. 6A). The second extending portion 62D is a portion extending in a direction opposite to the first extending portion 62B from the returning member fulcrum portion 62A. The second extending portion 62D is pressed by the second cam 602.

As seen in FIG. 3 and FIG. 8A, the holder 70 pivotally supports the first retard roller 114. The first retard roller 114 is supported by a pair of sidewalls of the holder 70 in which the sidewalls are arranged at a distance from each other in the lateral direction. The holder 70 can have its position changed between an opposite position where the first retard roller 114 forms a nip portion between the first retard roller 114 and the first sheet feeding roller 113 and a retracting position where the first retard roller 114 is retracted from the first sheet feeding roller 113. The holder 70 includes a holder fulcrum portion 70A and a holder protruding portion 70B. The holder fulcrum portion 70A is a fulcrum portion for pivoting of the holder 70. The holder fulcrum portion 70A protrudes in the lateral direction from each of the sidewalls of the holder 70. The holder fulcrum portion 70A is rotatably pivotally supported by the conveyance guide section 100. The holder protruding portion 70B (FIG. 8A) is a protruding piece protruding downward from a right end of the holder 70. On the other hand, as seen in FIG. 8A, the conveyance guide section 100 includes a guide inner wall portion 100H and a holder bias spring 100K. As depicted in FIG. 6A, an installation portion in which the holder 70 can be installed is disposed on an upper surface portion (curved portion 100A) of the conveyance guide section 100. The guide inner wall portion 100H is an inner wall portion of the conveyance guide section 100 which defines the installation portion and which lies opposite the holder 70. The holder bias spring 100K is a spring compressively disposed between the guide inner wall portion 100H and the holder protruding portion 70B. The holder bias spring 100K biases the holder 70 around the holder fulcrum portion 70A so as to bring the first retard roller 114 into abutting contact with the first sheet feeding roller 113. Furthermore, as depicted in FIG. 8A, an idler gear 113A is disposed between the first sheet feeding roller 113 and the first pickup roller 112. The idler gear 113A engages simultaneously with the first sheet feeding roller 113 and the first pickup roller 112. When a driving force generated by the motor M described above is transmitted to the first sheet feeding roller 113, the first pickup roller 112 is rotated via the idler gear 113A. Furthermore, the first retard roller 114 can rotate in conjunction with the first sheet feeding roller 113, and rotation of the first retard roller 114 stops when the sheets are handled one by one.

As depicted in FIG. 4A and FIG. 5A, when the first shaft 600 is placed at a predetermined rotational angle, a first cam large-diameter portion 601A of the first cam 601 presses the arm pressed section 61D of the pressing arm 61 downward. As a result, the pressing arm 61 pivots around the arm fulcrum section 61C, and the arm pressing section 61A presses the lift plate protruding portion 111A downward. As a result, the first lift plate 111 is moved downward and placed in the retracting position against the bias force of the above-described bias spring provided below the first lift plate 111 (FIG. 2A). On the other hand, when the first shaft 600 is rotated through a predetermined angle from the state depicted in FIG. 4A and FIG. 5A, the first shaft 600 is placed at a rotational angle depicted in FIG. 4B and FIG. 5B. Specifically, a portion of the first cam 601 that comes into abutting contact with the arm pressed section 61D changes from the first cam large-diameter portion 601A to a first cam small-diameter portion 601B. As a result, the bias force of the bias spring causes the first lift plate 111 to be moved upward and placed in the sheet feeding position while causing the pressing arm 61 to pivot around the arm fulcrum section 61C (FIG. 2B). Thus, in response to rotation of the first shaft 600, the first lift plate 111 is periodically placed in the sheet feeding position and in the retracting position.

Furthermore, at a predetermined rotational angle of the first shaft 600, the second cam small-diameter portion 602B of the second cam 602 is placed opposite the second extending portion 62D of the returning member 62 as depicted in FIG. 7A. At this time, the sheet abutting contact portion 62C of the returning member 62 protrudes into the main conveying path 10A via the slit 100G (FIG. 6A). When the first shaft 600 is rotated from the state depicted in FIG. 7A, as depicted by an arrow, a second cam step portion 602B of the second cam 602 presses the second extending portion 62D, and the returning member 62 rotates around the returning member fulcrum portion 62A. At this time, the returning member 62 rotates against the bias force of the coil spring provided around the returning member fulcrum portion 62A. As a result, a second cam large-diameter portion 602C of the second cam 602 comes into contact with the second extending portion 62D and the first extending portion 62B to regulate rotation of the returning member 62, as depicted in FIG. 7B. As a result, the sheet abutting contact portion 62C of the returning member 62 is retracted downward from the slit 100G (FIG. 6B). Thus, in response to rotation of the first shaft 600, the sheet abutting contact portion 62C of the returning member 62 periodically projects into and retracts from the main conveying path 10A.

Moreover, at a predetermined rotational angle of the first shaft 600, a third cam large-diameter portion 603A of the third cam 603 presses the holder protruding portion 70B of the holder 70 against the bias force of the holder bias spring 100K, as depicted in FIG. 8A. As a result, the holder 70 pivots around the holder fulcrum portion 70A, and the first retard roller 114 separates from the first sheet feeding roller 113. Furthermore, when the first shaft 600 is rotated from the state depicted in FIG. 8A, as depicted by an arrow, a third cam small-diameter portion 603B of the third cam 603 is placed opposite the holder protruding portion 70B as depicted in FIG. 8B. At this time, a predetermined gap is formed between the third cam small-diameter portion 603B and the holder protruding portion 70B, and thus, the bias force of the holder bias spring 100K causes the holder protruding portion 70B to be biased leftward. Therefore, the holder 70 pivots around the holder fulcrum portion 70A, bringing the first retard roller 114 into abutting contact with the first sheet feeding roller 113. Thus, in response to rotation of the first shaft 600, the first retard roller 114 periodically contacts and leaves the first sheet feeding roller 113.

In the present embodiment, when the first shaft 600 is rotated through a predetermined angle from the sheet feeding position of the first lift plate 111 depicted in FIG. 2B and FIG. 4B, the first lift plate 111 is placed in the retracting position (FIG. 4A), and the first retard roller 114 is placed in the retracting position of the holder 70 so as to retract from the first sheet feeding roller 113 (FIG. 8A). Moreover, when the first shaft 600 is rotated through the predetermined angle, the sheet abutting contact portion 62C of the returning member 62 protrudes from the downstream side toward the upstream side in the conveying direction of the sheet, that is, toward the sheet feeding cassette 11, into the main conveying path 10A (FIG. 4A). Then, when the first shaft 600 further rotates, the first retard roller 114 comes into abutting contact with the first sheet feeding roller 113 to retract the sheet abutting contact portion 62C of the returning member 62 from the main conveying path 10A, substantially simultaneously with the replacement of the first lift plate 111 in the sheet feeding position. The outer circumferential shapes of the first cam 601, the second cam 602, and the third cam 603 around the first shaft 600 are set so as to achieve the above-described operation during one rotation of the first shaft 600. Thus, rotating the first shaft 600, a single shaft, enables a plurality of members to be driven.

Figure 9A:
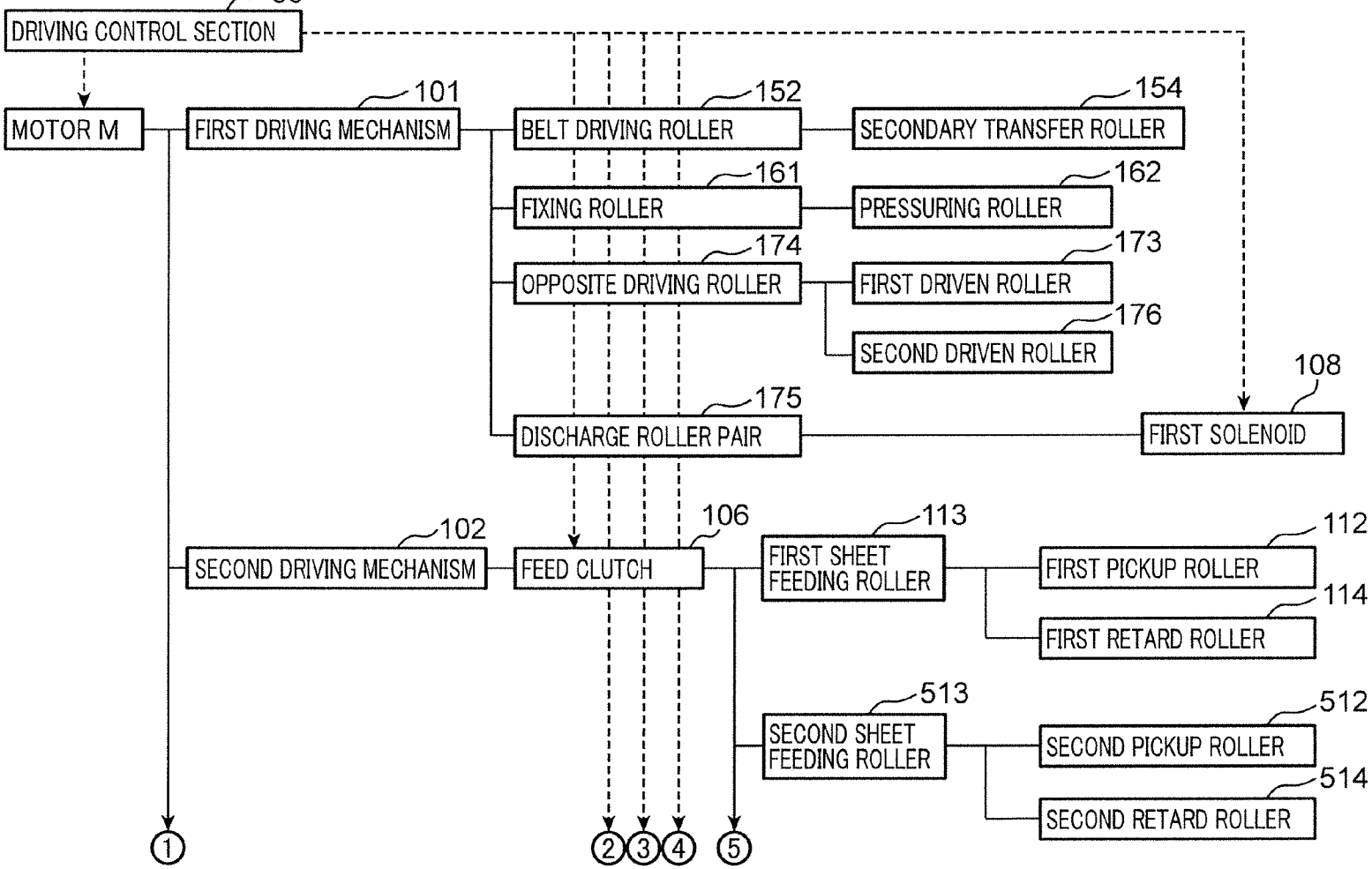
FIG. 9A and FIG. 9B are electrical block diagrams of the image forming apparatus according to the embodiment of the present disclosure.
Figure 9B:
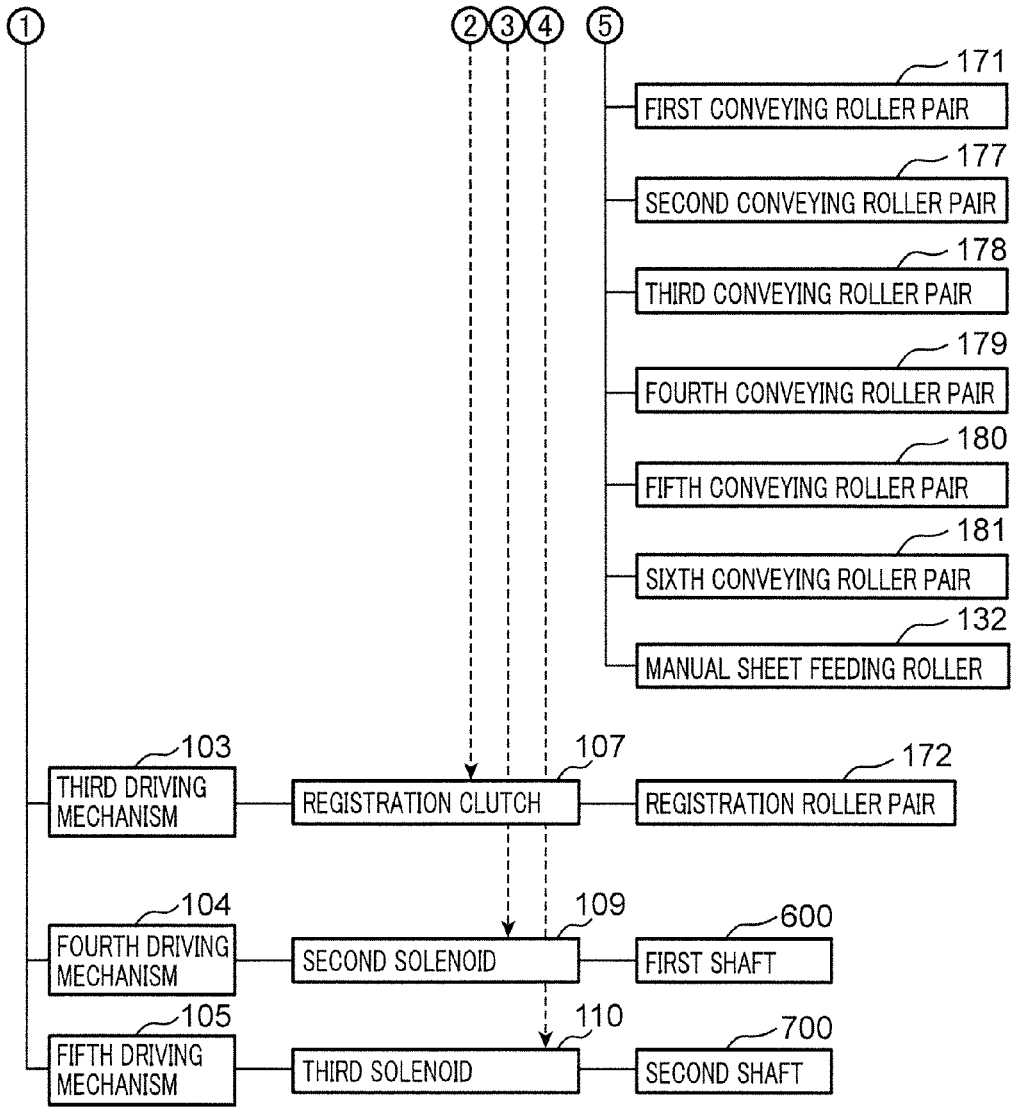

Now, a driving mechanism in the image forming apparatus 1 will be described. FIG. 9A and FIG. 9B are electrical block diagram of the image forming apparatus 1 according to the present embodiment. FIG. 9A and FIG. 9B depict one block diagram, and reference numerals 1 to 5 corresponding to solid or dashed lines in FIG. 9A are connected to reference numerals 1 to 5 corresponding to solid or dashed lines in FIG. 9B, respectively. The image forming apparatus 1 includes the driving control section 80 and the motor M (driving section) (FIG. 9A). The driving control section 80 rotationally drives the motor M and controls a feed clutch 106, a registration clutch 107, a first solenoid 108, a second solenoid 109, and a third solenoid 110 described below. The motor M is a motor that generates a rotational driving force. The driving force generated by the motor M enables a plurality of members (for example, conveying rollers including the fixing section 16) to be driven. Moreover, the image forming apparatus 1 includes a first driving mechanism 101 (FIG. 9A), a second driving mechanism 102 (FIG. 9A), a third driving mechanism 103 (FIG. 9B), a fourth driving mechanism 104 (FIG. 9B), and a fifth driving mechanism 105 (FIG. 9B). Furthermore, the image forming apparatus 1 includes the feed clutch 106 (first switching section) (FIG. 9A), the registration clutch 107 (FIG. 9B), the first solenoid 108 (FIG. 9A), the second solenoid 109 (second switching section) (FIG. 9B), and the third solenoid 110 (third switching section) (FIG. 9B).

The first driving mechanism 101 is a driving row including a group of gears coupled to the motor M. The first driving mechanism 101 is coupled to the above-described belt driving roller 152, fixing roller 161, opposite driving roller 174, and discharge roller pair 175. That is, driving of the motor M allows the group of rollers to be constantly rotated. As described above, the secondary transfer roller 154, the pressuring roller 162, the first driven roller 173, and the second driven roller 176 are simultaneously driven in conjunction with the above-described rollers. Furthermore, one roller of the discharge roller pair 175 is driven by the motor M, whereas the other roller rotates as a driven roller. This also applies to the following other roller pairs.

The second driving mechanism 102 is similarly a driving row including a group of gears coupled to the motor M. The second driving mechanism 102 is coupled, via the feed clutch 106, to the above-described first sheet feeding roller 113, second sheet feeding roller 513, first conveying roller pair 171, second conveying roller pair 177, third conveying roller pair 178, fourth conveying roller pair 179, fifth conveying roller pair 180, sixth conveying roller pair 181, and manual sheet feeding roller 132. When the motor M is driven, the group of rollers is rotated if the feed clutch 106 is turned on. As described above, the first pickup roller 112, the first retard roller 114, the second pickup roller 512, and the second retard roller 514 are simultaneously rotated in conjunction with the above-described rollers.

The third driving mechanism 103 is similarly a driving row including gears coupled to the motor M. The third driving mechanism 103 is coupled to a first roller of the above-described registration roller pair 172 via the registration clutch 107. A second roller of the registration roller pair 172 rotates in conjunction with the first roller. When the motor M is driven, the rollers are rotated if the registration clutch 107 is turned on.

The fourth driving mechanism 104 is similarly a driving row including gears coupled to the motor M. The fourth driving mechanism 104 is coupled to the shaft gear 600A of the above-described first shaft 600 via the second solenoid 109. When the motor M is driven, the first shaft 600 is rotated if the second solenoid 109 is turned on.

The fifth driving mechanism 105 is similarly a driving row including gears coupled to the motor M. The fifth driving mechanism 105 is coupled to a second shaft 700 via the third solenoid 110. The second shaft 700 is a shaft disposed in the additional cassette 50 in association with the first shaft 600 in the sheet feeding cassette 11. Around the second shaft 700, a first cam, a second cam, a third cam, a pressing arm, a returning member, and a holder (support member), which are not shown in figures, are provided as is the case with the above-described interlocking section 60. When the motor M is driven, the second shaft 700 is rotated if the third solenoid 110 is turned on. This allows implementation of up-down movement of the second lift plate 511 (FIG. 1), an operation of allowing the second retard roller 514 to contact and leave the second sheet feeding roller 513, and an operation of projecting and retracting the returning member provided around the second sheet feeding roller 513 and not depicted in the drawings.

The feed clutch 106 (first switching section) transmits the driving force generated by the motor M to the first sheet feeding rollers 113 and 177 and the like to synchronously rotate or stop these rollers. Similarly, the registration clutch 107 transmits the driving force generated by the motor M to the registration roller pair 172 to synchronously rotate or stop these rollers. The first solenoid 108 controls the rotating direction of the discharge roller pair 175 rotated by the motor M. This allows switching between discharge of the sheet into the sheet discharging section 12 (FIG. 1) and loading of the sheet into the reverse conveying path 10C. The second solenoid 109 transmits the driving force generated by the motor M to the first lift plate 111 via the interlocking section 60 (FIG. 3) to change the position of the first lift plate 111. Furthermore, the second solenoid 109 transmits the driving force generated by the motor M to the returning member 62 and the holder 70 via the interlocking section 60 to perform an operation of projecting and retracting the returning member 62 and an operation of moving the holder 70. The third solenoid 110 is controlled by the driving control section 80 to transmit the driving force generated by the motor M to the second lift plate 511 to change the position of the second lift plate 511 as is the case with the second solenoid 109. Additionally, the third solenoid 110 allows performance of an operation of allowing the second retard roller 514 provided in the additional cassette 50 to contact and leave the second sheet feeding roller 513 and an operation of projecting and retracting the returning member not depicted in the drawings.

As described above, in the present embodiment, the driving force generated by the motor M is utilized to drive the plurality of members. In particular, a common driving section is used to drive the first pickup roller 112, the second pickup roller 512, the second conveying roller pair 177, the third conveying roller pair 178, the first lift plate 111, and the second lift plate 511, which are distributed over a wide range in the image forming apparatus 1. Therefore, compared to a case where more motors are provided in order to individually drive these members, the present embodiment reduces the size of the apparatus main body 10 of the image forming apparatus 1 and the weight of the image forming apparatus 1. Moreover, the present embodiment reduces the number of driving transmission mechanisms such as clutches and solenoids which transmit the driving force of the motor M to the rollers. Furthermore, the sharing of the same driving section and driving transmission mechanism enables a reduction in the costs of the image forming apparatus 1.

On the other hand, the sharing of the same driving source as described above is likely to pose problems described below. First, a problem may occur at the time of duplex image formation utilizing the reverse conveying path 10C. The image forming section 14 forms an image on the first sheet delivered from the sheet feeding cassette 11 by the first pickup roller 112. Then, for duplex image formation, the sheet is switched back by means of the discharge roller pair 175 and loaded into the reverse conveying path 10C. Then, the second conveying roller pair 177 and the third conveying roller pair 178 convey the sheet toward the main conveying path 10A again. However, when the second conveying roller pair 177 and the third conveying roller pair 178 are rotationally driven in this manner, the first pickup roller 112 and first sheet feeding roller 113 coupled to the second driving mechanism 102 (FIG. 9A), to which the second conveying roller pair 177 and the third conveying roller pair 178 are also coupled, also rotate. Thus, another sheet is delivered into the main conveying path 10A from the sheet feeding cassette 11. In this case, disadvantageously, a plurality of sheets overlap in the main conveying path 10A.

In the present embodiment, to solve such a problem, the driving control section 80 controls the feed clutch 106 to rotate the first pickup roller 112 with the first lift plate 111 placed in the sheet feeding position to load the sheet into the image forming section 14. Subsequently, when the sheet is loaded into the reverse conveying path 10C through the main conveying path 10A and the discharge conveying path 10B, the driving control section 80 controls the second solenoid 109 to rotate and move the first shaft 600, thereby moving the first lift plate 111 from the sheet feeding position to the retracting position.

Thus, when the preceding sheet is conveyed through the reverse conveying path 10C, the sheets stacked on the first lift plate 111 are prevented from being delivered by the first pickup roller 112. Then, at a timing when a predetermined sheet interval is formed between a trailing end of the sheet being conveyed through the reverse conveying path 10C and the leading end of the succeeding sheet, the driving control section 80 places the first lift plate 111 in the sheet feeding position again. The first pickup roller 112 then loads the succeeding sheet into the main conveying path 10A.

Moreover, in the present embodiment, rotation of the first shaft 600 causes, in addition to lowering of the first lift plate 111, separation of the first retard roller 114 from the first sheet feeding roller 113 and protrusion of the returning member 62 into the main conveying path 10A as described above. When the first retard roller 114 is retracted from the first sheet feeding roller 113, the nip portion formed between the first retard roller 114 and the first sheet feeding roller 113 is opened. This prevents the first sheet feeding roller 113 and the first retard roller 114 from braking the trailing end of the sheet conveyed by the registration roller pair 172 located on the downstream side of the first sheet feeding roller 113. Furthermore, opening of the nip portion prevents the succeeding sheet delivered to the vicinity of the first sheet feeding roller 113 from being conveyed downstream. Additionally, the protrusion of the returning member 62 also prevents the succeeding sheet from being erroneously delivered. These manners of control also performed when the sheet is delivered from the additional cassette 50.

Moreover, in the present embodiment, the sheet feeding cassette 11 and the additional cassette 50 are installed in an installation direction depicted by arrow DC in FIG. 1, and the inlet sides of the main conveying path 10A and the additional conveying path 10E extend along the installation direction, as described above. Thus, when the sheet feeding cassette 11 or the additional cassette 50 is pulled out from the apparatus main body 10 with the sheet held at the nip portion between the first sheet feeding roller 113 and the first retard roller 114 or between the second sheet feeding roller 513 and the second retard roller 514, the sheet remains inside the apparatus main body 10.

In the present embodiment, to solve such a problem, the driving control section 80 controls the second solenoid 109 and the third solenoid 110 to move the first lift plate 111 and the second lift plate 511 to the retracting positions when a series of image formation operations (print job) ends. At this time, the first retard roller 114 and the second retard roller 514 are retracted downward from the first sheet feeding roller 113 and the second sheet feeding roller 513, respectively. Moreover, the returning member 62 and the returning member provided in the additional cassette 50 and not depicted in the drawings protrude into the main conveying path 10A and the additional conveying path 10E, respectively. Thus, the leading end of the sheet held at the nip portion as described above is quickly pushed back to the sheet feeding cassette 11 or additional cassette 50 located on the upstream side in the conveying direction. As a result, even when the user pulls the sheet feeding cassette 11 or the additional cassette 50 out from the apparatus main body 10, the sheet is prevented from remaining inside the apparatus main body 10.

Furthermore, in the present embodiment, when the additional cassette 50 is installed in the apparatus main body 10, a plurality of cassettes (sheet feeding cassette 11 and additional cassette 50) is provided in the image forming apparatus 1. The first pickup roller 112 corresponding to the sheet feeding cassette 11 and the second pickup roller 512 corresponding to the additional cassette 50 are coupled to the common second driving mechanism 102 and switched by the feed clutch 106 so that the start of rotation of one of the rollers synchronizes with the stop of the other. Thus, when sheets from both cassettes are inadvertently loaded into the main conveying path 10A, sheet jam occurs in the main conveying path 10A.

In the present embodiment, to prevent such a problem, the driving control section 80 places the lift plate of a first one of the sheet feeding cassette 11 and additional cassette 50 in the sheet feeding position, while placing the lift plate of a second cassette in the retracting position when the sheet is delivered from the first cassette to the image forming section 14. Thus, even when the first pickup roller 112 and the second pickup roller 512 are simultaneously rotationally driven, the sheet is prevented from coming into abutting contact with the pickup roller in the cassette on which the sheet feeding operation is not performed. This prevents sheets from being inadvertently fed from both cassettes. Furthermore, also in this case, the driving control section 80 controls the second solenoid 109 to change the position of the holder 70 corresponding to the lift plate for the position change from the opposite position to the retracting position and to allow the returning member 62 to protrude into the main conveying path 10A or the additional conveying path 10E, using the driving force generated by the motor M.

The image forming apparatus 1 according to the embodiment of the present disclosure has been described. However, the present disclosure is not limited to this, and for example, such variations as described below may be adopted.

(1) In the above-described embodiment, the aspect has been described in which the image forming apparatus 1 includes the reverse conveying path 10C and in which the additional cassette 50 can be selectively installed. However, the present disclosure is not limited to this. In a variation, an aspect is possible in which the image forming apparatus 1 does not have the reverse conveying path 10C or the additional cassette 50. Even when the image forming apparatus 1 does not include the reverse conveying path 10C, the main conveying path 10A and additional conveying path 10E extending from the sheet feeding cassette 11 or the additional cassette 50 join together on the upstream side with respect to the registration roller pair 172. Thus, to prevent the sheet feeding operation from being simultaneously performed on both cassettes, the lift plate of one of the cassettes may be placed in the retracting position as described above.

Furthermore, even when the image forming apparatus 1 does not include the additional cassette 50, the main conveying path 10A and reverse conveying path 10C extending from the sheet feeding cassette 11 join together on the upstream side with respect to the registration roller pair 172. Thus, to prevent the sheet from being fed from the sheet feeding cassette 11 while another sheet is being conveyed through the reverse conveying path 10C, the first lift plate 111 of the sheet feeding cassette 11 may be placed in the retracting position as described above.

(2) Furthermore, in the above-described embodiment, the aspect has been described in which, in response to movement of the first lift plate 111 to the retracting position, the first retard roller 114 is refracted from the first sheet feeding roller 113 to allow the sheet abutting contact portion 62C of the returning member 62 to protrude into the main conveying path 10A. However, the present disclosure is not limited to this. In a variation, an aspect is possible in which the operation of refracting the first retard roller 114 and the operation of allowing the sheet abutting contact portion 62C to protrude are not performed.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus comprising:

an apparatus main body;

a sheet feeding cassette that is removable from the apparatus main body, and in which sheets are stacked;

an image forming section that forms an image on the sheet;

a sheet conveying path that extends from the sheet feeding cassette so as to pass through the image forming section, and through which the sheet is conveyed;

a reverse conveying path that is formed downstream of the image forming section in a conveying direction of the sheet so as to branch from the sheet conveying path, the reverse conveying path allowing, during duplex image formation in which an image is formed on each of opposite surfaces of the sheet, the sheet to be loaded again into an upstream side portion of the sheet conveying path with respect to the image forming section in the conveying direction;

a delivery member that is disposed opposite the sheet feeding cassette and rotationally driven to deliver the sheet;

a conveying member that is disposed in the reverse conveying path and rotationally driven to convey the sheet;

a lift plate that is disposed in the sheet feeding cassette so that the sheet is stacked on an upper surface of the lift plate, the lift plate being enabled to change a position thereof between a sheet feeding position where the stacked sheet is brought into abutting contact with the delivery member and a retracting position where the sheet is retracted from the delivery member;

a driving section that generates a driving force;

a first switching section that transmits the driving force generated by the driving section to the delivery member and the conveying member to rotate or stop the delivery member and the conveying member;

a second switching section that transmits the driving force generated by the driving section to the lift plate to change the position of the lift plate; and a driving control section that controls the first switching section and the second switching section, wherein the driving control section controls the first switching section, with the lift plate being placed in the sheet feeding position, to rotate the delivery member to feed the sheet into the sheet conveying path, and when the sheet is conveyed through the reverse conveying path, controls the second switching section to move the lift plate from the sheet feeding position to the retracting position.

2. The image forming apparatus according to claim 1, further comprising:

a sheet feeding member that is disposed downstream of the delivery member in the conveying direction and rotated to convey the sheet;

an opposite member that is disposed opposite the sheet feeding member to form, between the opposite member and the sheet feeding member, a nip portion through which the sheet passes; and a support member that supports the opposite member and is enabled to change a position thereof between an opposite position where the opposite member forms the nip portion and a retracting position where the opposite member is retracted from the sheet feeding member, wherein in response to the position change of the lift plate from the sheet feeding position to the retracting position, the driving control section controls the second switching section to move the support member from the opposite position to the retracting position, using the driving force generated by the driving section.

3. The image forming apparatus according to claim 2, further comprising:

a returning member that protrudes into the sheet conveying path around the sheet feeding member to push the sheet, delivered from the sheet feeding cassette to the sheet conveying path, back to an upstream side in the conveying direction, wherein in response to the position change of the lift plate from the sheet feeding position to the retracting position, the driving control section controls the second switching section to cause the returning member to protrude into the sheet conveying path, using the driving force generated by the driving section.

4. The image forming apparatus according to claim 2, wherein the sheet feeding cassette is installed in a predetermined installation direction with respect to the apparatus main body, the sheet conveying path extends along the installation direction from the sheet feeding cassette, and the driving control section controls the second switching section and moves the lift plate to the retracting position when a predetermined image formation operation on the sheet ends.

5. The image forming apparatus according to claim 3, further comprising:

a shaft disposed on the apparatus main body to be coupled to the driving section, and moreover rotated by the driving section, the shaft having a first cam, a second cam and a third cam disposed on a circumferential surface of the shaft;

the first cam moves the lift plate up and down between the sheet feeding position and the retracting position;

the second cam projects and retracts the returning member into and from the sheet conveying path; and the third cam moves the support member between the opposite position and the retracting position.

6. An image forming apparatus comprising:

an apparatus main body;

a first sheet feeding cassette and a second sheet feeding cassette that are removable from the apparatus main body, and in which sheets are stacked;

an image forming section that forms an image on the sheet;

a sheet conveying path configured to extend from the first sheet feeding cassette and the second sheet feeding cassette into the apparatus main body, the sheet is conveyed through the sheet conveying path;

a first delivery member that is disposed opposite the first sheet feeding cassette and rotationally driven to deliver the sheet;

a second delivery member that is disposed opposite the second sheet feeding cassette and rotationally driven to deliver the sheet;

a first lift plate that is disposed in the first sheet feeding cassette so that the sheet is stacked on an upper surface of the first lift plate, the first lift plate being enabled to change a position thereof between a sheet feeding position where the stacked sheet is brought into abutting contact with the first delivery member and a retracting position where the sheet is retracted from the first delivery member;

a second lift plate that is disposed in the second sheet feeding cassette so that the sheet is stacked on an upper surface of the second lift plate, the second lift plate being enabled to change a position thereof between a sheet feeding position where the stacked sheet is brought into abutting contact with the second delivery member and a retracting position where the sheet is retracted from the second delivery member;

a driving section that generates a driving force;

a first switching section that transmits the driving force generated by the driving section to the first and second delivery members to rotate or stop the first and second delivery members;

a second switching section that transmits the driving force generated by the driving section to the first lift plate to change the position of the first lift plate;

a third switching section that transmits the driving force generated by the driving section to the second lift plate to change the position of the second lift plate; and a driving control section that controls the first switching section, the second switching section, and the third switching section, wherein the driving control section controls the second switching section or the third switching section to place one of the first lift plate and the second lift plate in the sheet feeding position, while placing the other of the first lift plate and the second lift plate in the retracting position, and in this state, controls the first switching section to rotate the first and second delivery members to feed the sheet into the sheet conveying path.

7. The image forming apparatus according to claim 6, further comprising:

sheet feeding members disposed downstream of the first and second delivery members, respectively, in the conveying direction and rotated to convey the sheet;

opposite members disposed opposite the respective sheet feeding members to form, between the opposite member and the sheet feeding member, a nip portion through which the sheet passes; and support members that support the respective opposite members and are enabled to change a position thereof between an opposite position where the opposite member forms the nip portion and a retracting position where the opposite member is retracted from the sheet feeding member, wherein in response to the position change of the first or second lift plate from the sheet feeding position to the retracting position, the driving control section controls the second switching section to move the support member from the opposite position to the retracting position, using the driving force generated by the driving section.

8. The image forming apparatus according to claim 7, further comprising:

returning members that protrude into the sheet conveying path around each of the sheet feeding members to push the sheet, delivered from the first or second sheet feeding cassette to the sheet conveying path, back to an upstream side in the conveying direction, wherein in response to the position change of the first or second lift plate from the sheet feeding position to the retracting position, the driving control section controls the second switching section or the third switching section to cause the returning member to protrude into the sheet conveying path, using the driving force generated by the driving section.

9. The image forming apparatus according to claim 7, wherein the first and second sheet feeding cassettes are installed in a predetermined installation direction with respect to the apparatus main body, the sheet conveying path extends along the installation direction from the first and second sheet feeding cassettes, and the driving control section controls the second switching section and the third switching section to move the first and second lift plates in the retracting positions when a predetermined image formation operation on the sheet ends.

10. The image forming apparatus according to claim 8, further comprising:

a first shaft and a second shaft disposed on the apparatus main body, and coupled to the driving section to be rotated by the driving section, the first shaft and the second shaft each having a first cam, a second cam, and a third cam disposed on a circumferential surface of the first or second shaft;

the first cam moves the first or second lift plate up and down between the sheet feeding position and the retracting position;

the second cam projects and retracts the returning member into and from the sheet conveying path; and the third cam moves the support member between the opposite position and the retracting position.

* * * * *